US005638782A

United States Patent [19]

Eguchi et al.

[11] Patent Number: 5,638,782

[45] Date of Patent: Jun. 17, 1997

[54] VALVE TIMING CONTROL DEVICE

[75] Inventors: Katsuhiko Eguchi; Atsushi Sato, both of Kariya; Yoshiyuki Kawai, Nagoya, all of Japan

[73] Assignee: Aisin Seiki Kabushiki Kaisha, Aichi-ken, Japan

[21] Appl. No.: 606,486

[22] Filed: Mar. 4, 1996

[51] Int. Cl.[6] ..... F01L 1/344

[52] U.S. Cl. ..... 123/90.17; 123/90.31; 74/568 R; 464/2; 464/160

[58] Field of Search ..... 123/90.15, 90.17, 123/90.31; 74/567, 568 R; 464/1, 2, 160

[56] References Cited

U.S. PATENT DOCUMENTS

| | | | |
|---|---|---|---|
| 4,498,431 | 2/1985 | Nakamura et al. | 123/90.17 |
| 4,862,843 | 9/1989 | Kawamoto et al. | 123/90.17 |
| 5,012,774 | 5/1991 | Strauber et al. | 123/90.17 |
| 5,119,691 | 6/1992 | Lichti et al. | 123/90.17 |
| 5,195,471 | 3/1993 | Hara | 123/90.17 |

FOREIGN PATENT DOCUMENTS 5-77843 10/1993 Japan .

*Primary Examiner*—Weilun Lo
*Attorney, Agent, or Firm*—Hazel & Thomas

[57] ABSTRACT

A valve timing control device includes an input member to which a driving force is applied thereto, an output member having on its axis a cam for opening and closing a valve, a transmission member for transmitting torque between the output member and the input member and for changing the rotational position of the output member in relation to the input member in accordance with the position thereof, a slit member provided with a helical slit and secured to the input member and a passive member provided with a helical spline superposed with the helical slit of the slit member and secured to the output member. A base portion which is allowed to engage the helical slit of the slit member and a toothed portion which is allowed to engage with the helical spline of the passive member are formed in the transmission member so that the slit member is connected to the passive member via the slit member.

9 Claims, 12 Drawing Sheets

VALVE TIMING CONTROL DEVICE

BACKGROUND OF THE INVENTION

1. Field of the Invention

The present invention relates to a valve timing control device.

2. Description of the Prior Art

A typical valve timing control device is described, for example, in Japanese Examined Patent Publication Hei Number 5(1993)-77843. In this device, helical splines are formed both in the timing pulley-side member serving as a power input member and in the camshaft-side member serving as the power output member and having, on its axis, a cam for opening and closing a valve. In addition, a piston provided with inner and outer circumferential helical splines for engaging the respective angular splines of the two members transmits power from the timing pulley-side member to the camshaft-side member.

Thus, the above device requires that helical splines be formed in four locations and, in particular, requires that helical splines differing in phase, angle or direction sometimes be formed on the inner and outer circumferences thereof, resulting in a highly complex process for manufacturing this device.

SUMMARY OF THE INVENTION

It is, therefore, an object of the present invention to provide an improved valve timing control device which overcomes the above drawbacks.

It is another object of the present invention to provide an improved valve timing control device whose structure is simplified.

In order to achieve these objectives, there is provided an improved valve timing control device which includes an input member to which a driving force is applied thereto, an output member having on its axis a cam for opening and closing a valve, a transmission member for transmitting torque between said output member and said input member and for changing the rotational position of said output member in relation to said input member in accordance with the position thereof, a slit member provided with a helical slit and secured to said input member and a passage member provided with a helical spline superposed with the helical slit of said slit member and secured to said output member, wherein a base portion which is allowed to engage the helical slit of said slit member and a toothed portion which is allowed to engage with the helical spline of said passage member are formed in said transmission member so that said slit member is connected to said passive member via said slit member.

According to this improved valve timing control device, a transmission route for transmitting the driving force from the slit member to the passive member via the transmission member is formed and thereby torque is transmitted from the input member via the slit member to the output member via the passive member. Further, an angle-changing effect is created between the input member and the output member, depending on the engagement position of the helical slit and the base portion of the transmission member and on the engagement position of the helical spline and the toothed portion of the transmission member.

Thus, the fact that the base portion of the transmission member engages with the helical slit of the slit member makes it unnecessary to form splines between the slit member and the base portion of the transmission member, thus rendering manufacturing proportionally easier.

BRIEF DESCRIPTION OF THE DRAWINGS

Additional objects and advantages of the present invention will become more apparent from the following detailed description of preferred embodiments thereof when considered with reference to the attached drawings, in which.

DESCRIPTION OF THE PREFERRED EMBODIMENTS

A valve timing control device constituted in accordance with preferred embodiments of the present invention will be described with reference to the attached drawings.

First Embodiment

A valve timing control device 10 of the first embodiment will be described with reference to FIGS. 1 through 13.

Figure 1:
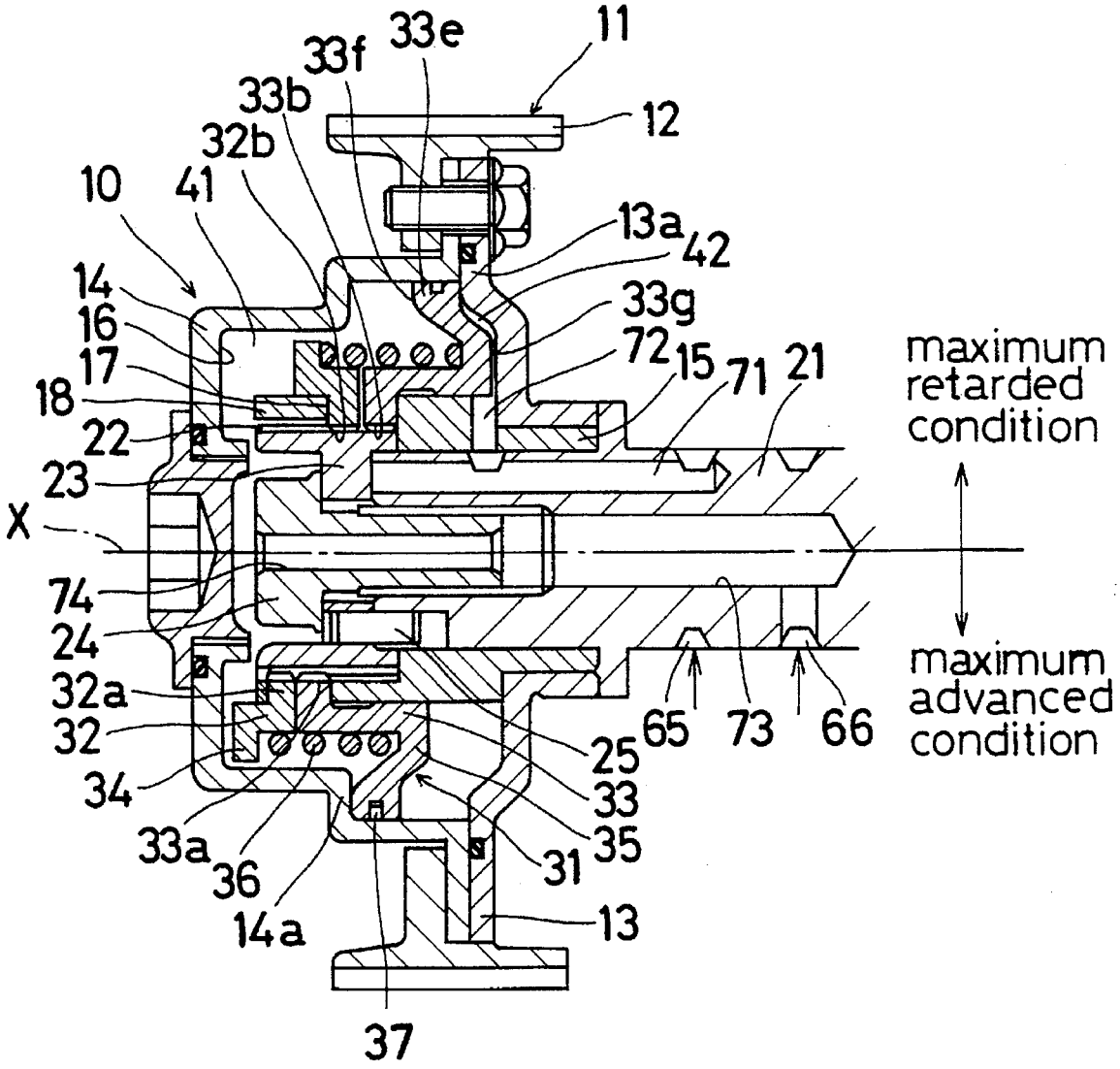
FIG. 1 is a cross-section of a first embodiment of a valve timing control device in accordance with the present invention.
Figure 2:
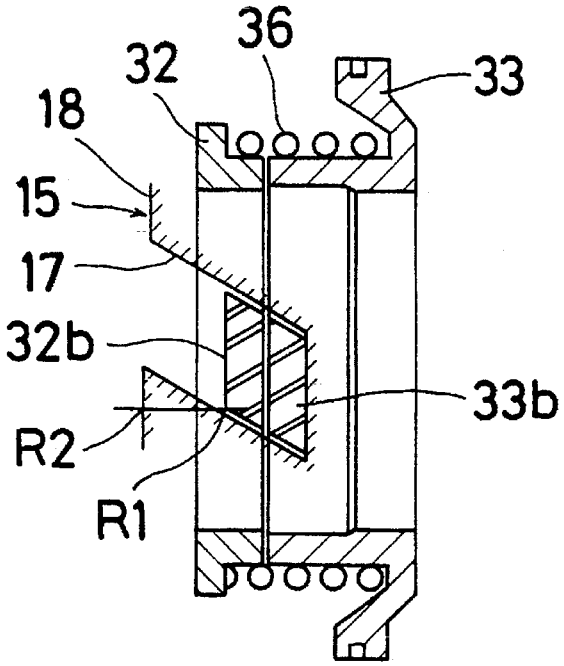
FIG. 2 is a sectional view taken substantially along the line A—A in FIG. 4 (at maximum advanced condition)
Figure 4:
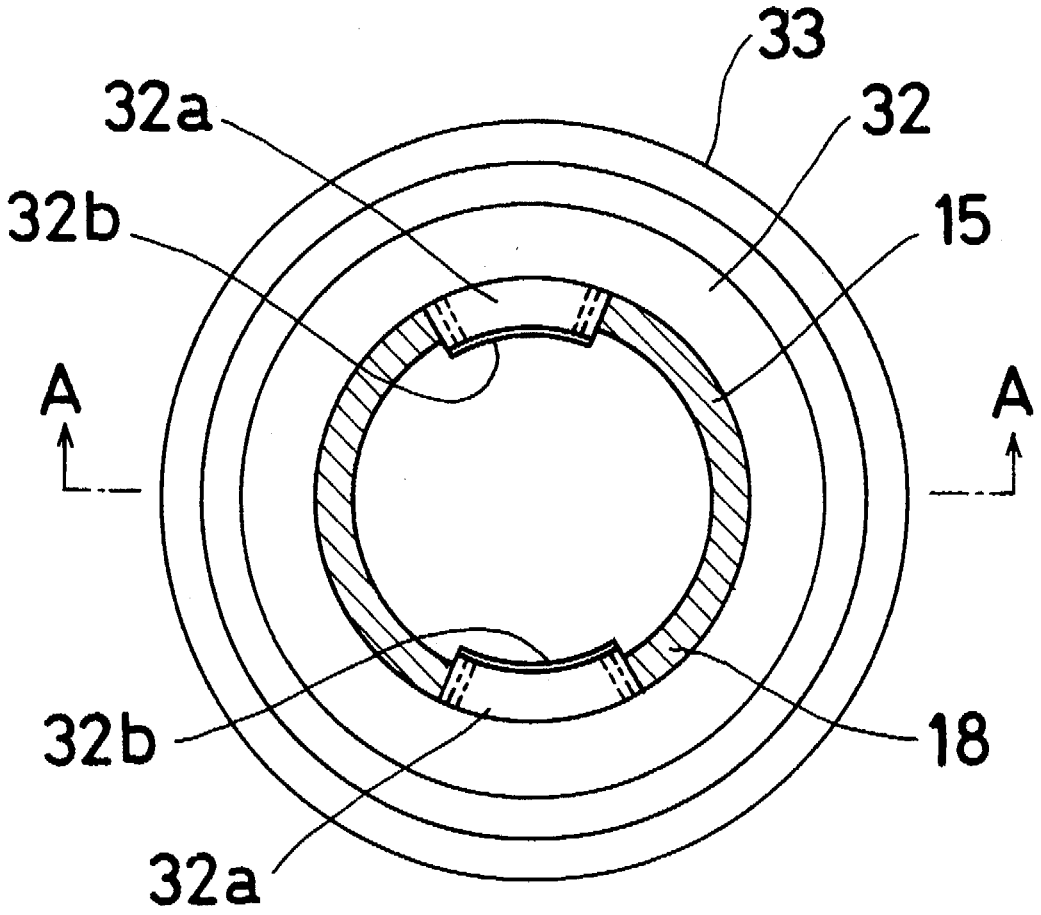
FIG. 4 is a front view of a piston and a slit member.
Figure 5:
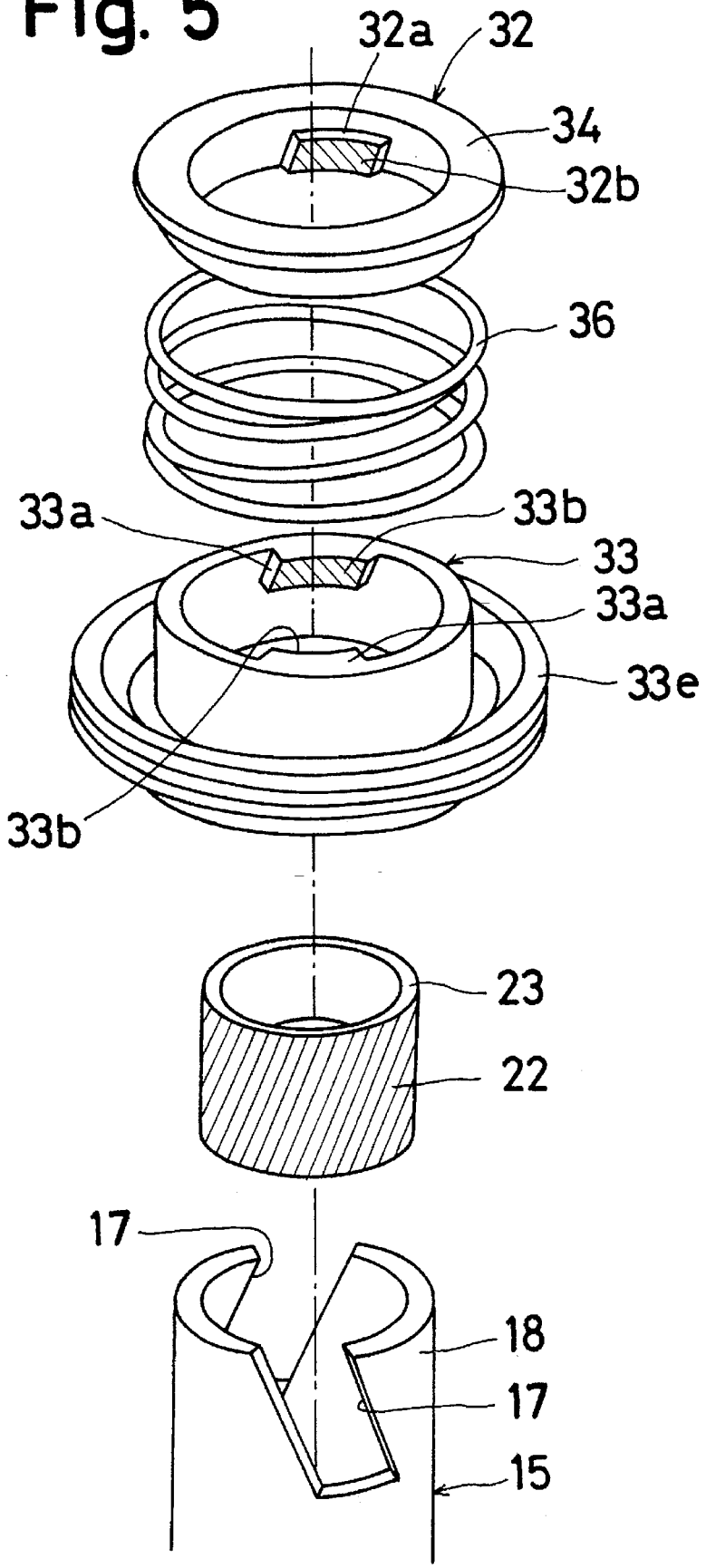
FIG. 5 is a partial exploded perspective view of the assembly illustrated in FIG. 1.

In FIG. 1, the valve timing control device 10 is depicted in such a way that the upper part above a horizontal center line X is in a maximum retarded condition and the lower part below this line is in a maximum advanced condition. Here, a timing pulley 11, which is an input member of the present invention, includes a gear component 12, a body 13, a cover 14 and a cylindrical slit member 15 and accommodates a chamber 16 in the interior thereof. The slit member 15 is supported around a camshaft 21, which is an output member of the present invention, while allowed to rotate in relation to the camshaft 21. The timing pulley 11 can therefore rotate in relation to the camshaft 21. The slit member 15 has a flange component 18 and helical slits 17 that are formed into a helix in the flange component 18, as shown in FIGS. 2, 4 and 5. It is desirable that at least a pair (two, as shown in FIGS. 4 and 5) of the helical slits 17 be formed along a diagonal. In addition, the helical slits 17 are inclined in mutually intersecting directions, as shown in FIG. 5.

Figure 9:
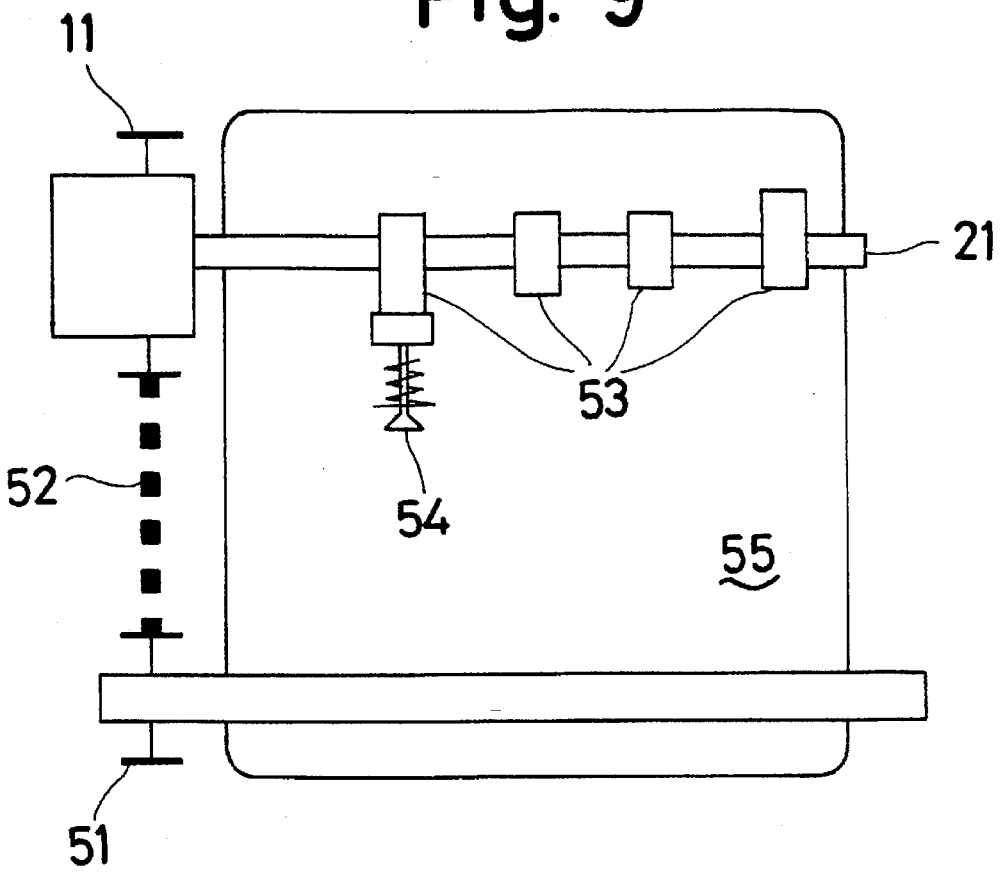
FIG. 9 is a block diagram of an engine.

The timing pulley 11 is connected to the crank pulley 51 of an engine 55 with the aid of a timing belt 52 and subjected to the action of the rotational force of the crank pulley 51, as shown in FIG. 9. A plurality of cams 53 corresponding to the number of cylinders in the engine 55 are provided around the outside of the camshaft 21 equipped with the valve timing control device 10, opening and closing at least the intake valves 54 (only one intake valve of the four intake valves is shown in FIG. 9) of the intake and exhaust valves of the engine 55.

Reverting back to FIG. 1, a passive member 23 having a helical spline 22 formed on its outside periphery is fixed with a bolt 24 to the left end of the camshaft 21 and the action of a pin 25 prevents the camshaft and the passive member 23 from rotating relative to each other. The helical spline 22 is located on the inside periphery of the flange component 18. The helical slits and the helical spline 22 are therefore superimposed.

A cylindrical piston 31, which is a transmission member of the present invention, is fitted around the slit member 15 inside the chamber 16 while allowed to slide in the axial direction. The piston 31 is divided in the axial direction into a first piston 32 and a second piston 33 and a spring 36, which is an elastic member, is placed between the corresponding retainers 34 and 35 of the two pistons, pushing them apart in a predetermined direction. The outside peripheral edge 33*e* of the second piston 33 is brought into close contact with the inner peripheral surface of the cover 14 via a seal member 37, dividing the chamber 16 into a retard-side hydraulic chamber 41 and an advance-side hydraulic chamber 42. The piston 31 can slide in the axial direction along the helical slits 17, and the sliding continues until the left end face of the outside peripheral edge 33*e* of the second piston 33 comes into contact with a speed component 14*a* during spark advance (lower half in FIG. 1). In addition, the left end face of the second piston 33 is a pressure-receiving surface 33*f* during the retard state, and the right end face is a pressure-receiving surface 33*g* during the advance state.

The first piston 32 and the second piston 33 have corresponding base components 32*a* and 33*a* that fit into the helical slits 17 of the slit member 15 and internal peripheral toothed components 32*b* and 33*b* that engage the external peripheral spline 22 are formed on the internal peripheral surfaces of these base components 32*a* and 33*a*. Because this embodiment involves forming two helical slits 17 along a diagonal, the entire cylindrical piston 31 is fitted with two base components 32*a* and 33*a* and two internal peripheral toothed components 32*b* and 33*b* for each of the helical slits 17. In other words, the base components (base portions) 32*a* and 33*a* and the internal peripheral toothed components (toothed portion) 32*b* and 33*b* are formed only along a portion (in two locations) of the circumference of the first and second pistons 32 and 33.

Figure 6:
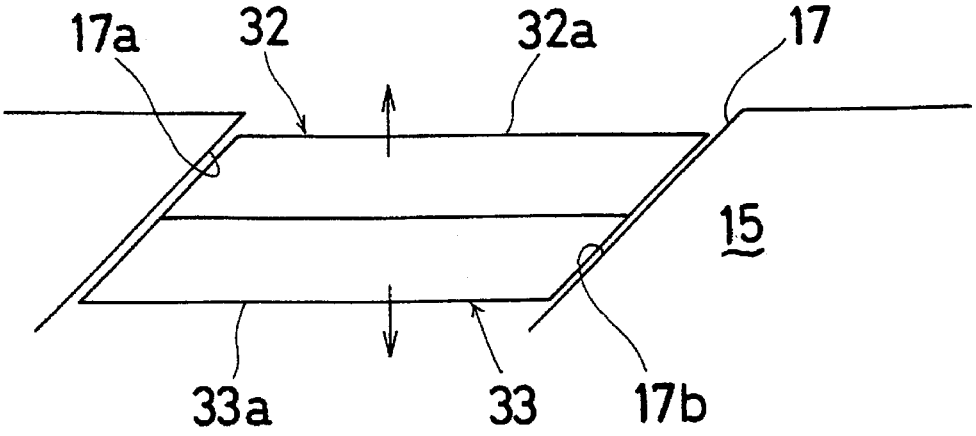
FIG. 6 is an explanatory diagram 1 for illustrating the manner in which the spring acts on the piston in the first embodiment.
Figure 7:
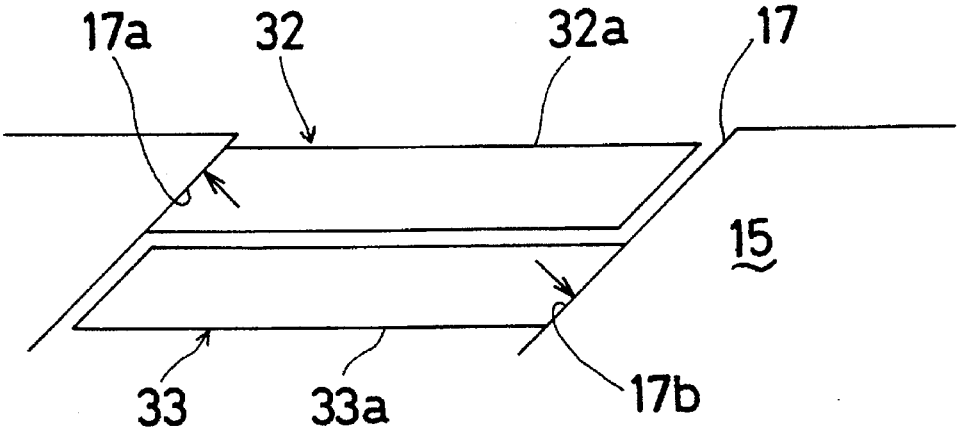
FIG. 7 is an explanatory diagram 2 for illustrating the manner in which the spring acts on the piston in the first embodiment.

Because the first and second pistons 32 and 33 are pushed apart by the spring 36, the first piston 32 moves upward in FIG. 6 and the second piston 33 moves downward in FIG. 6 from a state in which both pistons 32 and 33 are in contact with each other, as shown in FIG. 6. Specifically, the spring 36 exerts a spreading action on the cylindrical piston 31. The two pistons 32 and 33 are therefore stretched inside the helical slits 17 by the left slanted surface of the base component 32*a* of the first piston 32 coming into contact with the end faces 17*a* of the helical slits 17 and by the right slanted surface of the base component 33*a* of the second piston 33 coming into contact with the end faces 17*b* of the helical slits 17, as shown in FIG. 7. In other words, the two base components 32*a* and 33*a* are pressed against the end faces of the helical slits 17 and, in terms of the entire piston 31, there is no chatter against the helical slits 17.

Figure 8:
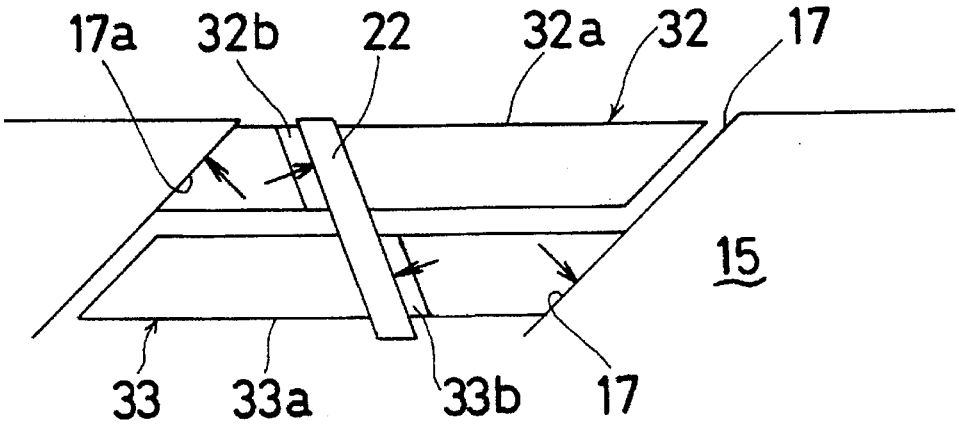
FIG. 8 is an explanatory diagram 3 for illustrating the manner in which the spring acts on the piston in the first embodiment.

The base components 32*a* and 33*a* of the two pistons 32 and 33 tend to further move apart the end faces 17*a* and 17*b* of the helical slits 17 as guides, but the two pistons 32 and 33 are stopped by the sandwiching of the helical spline 22 between the internal peripheral toothed components 32*b* and 33*b*. The two internal peripheral toothed components 32*b* and 33*b* are therefore pressed against the helical spline 22 and thereby the piston 31 does not rattle with respect to the helical spline 22. Furthermore, this pressing action generates a sliding resistance against the movement of the piston 31, whereby pressing forces also contribute toward the stopping piston 31 in the position. In FIG. 8 and in FIG. 13, the internal peripheral toothed components 32*b* and 33*b* and the helical spline 22 are shown only for one tooth with the rest omitted. The above descriptions made with reference to FIGS. 6 through 8 above are considered in cases where the piston 31 is in a state of maximum spark advance. However, the same effect may be produced in a state of maximum retarded condition or an intermediate advanced condition.

Figure 10:
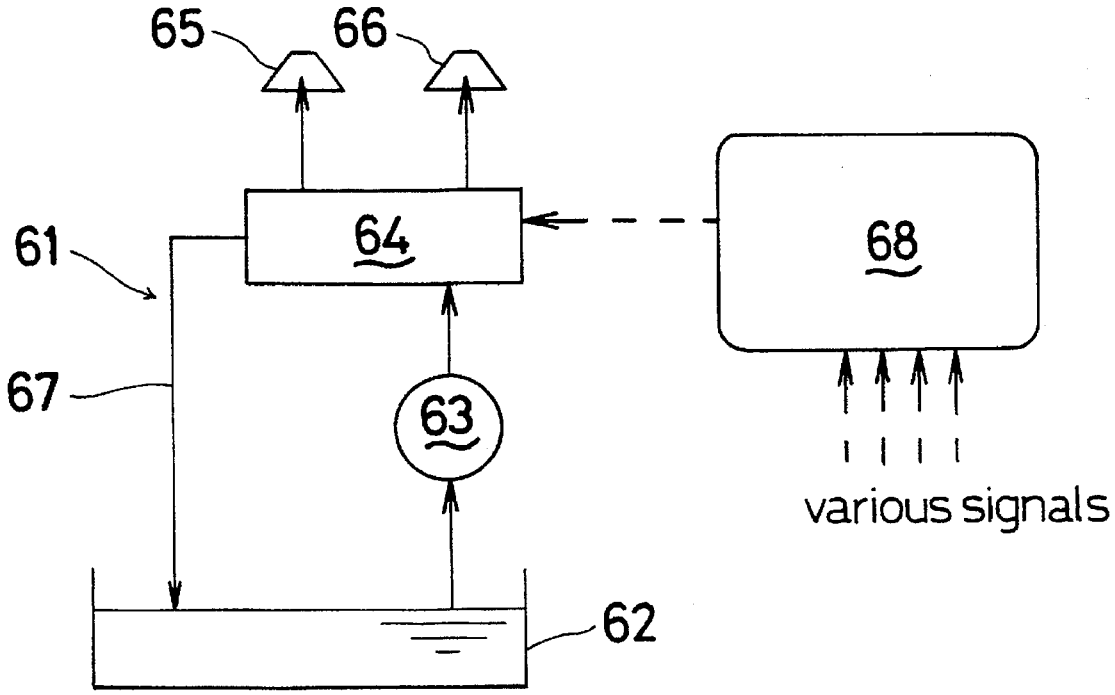
FIG. 10 is a block diagram of a hydraulic circuit.

The hydraulic circuit 61, shown in FIG. 10, applies an operating oil pressure to the valve timing control device 10. Here, a pump 63 draws oil from an oil pan 62 to generate oil pressure, and the oil pressure is applied by a hydraulic cutoff poppet valve 64 to the port 65 or 66 formed in the camshaft. A drawn circuit is shown at 56. The hydraulic cutoff poppet valve 64 is driven by a control device 68, which outputs an optimum control signal to the hydraulic cutoff poppet valve 64 in accordance with the inputted engine load signal, cam angle signal, crank angle signal, and various other signals. In FIG. 1, the ports 65 and 66 are formed into rings on the outside periphery of the camshaft 21. The port 65 is connected to one end of a conduit 71 extending in the axial direction inside the camshaft 21, and the conduit 71 is connected by the other end to the advance-side hydraulic chamber 42 via a conduit 72 formed in the slit member 15. The left end of the conduit 71 is sealed by the passive member 23. The port 66 is connected to one end of a conduit 73 extending in the axial direction along the center inside the camshaft 21, and to the retard-side hydraulic chamber 41 via a conduit 74 extending in the axial direction along the center inside the bolt 24.

The operation of the valve timing control device 10 having the above structure will now be described.

With the starting of the engine 55, the piston 31 immediately moves into the position of the maximum retarded condition shown in the upper half of FIG. 1. This is because the piston 31 is oriented in such a way that it moves into the position of the maximum retarded condition because of the relation between the rotational direction of the timing pulley 11 and the incline direction of the helical spline 22 or helical slits 17 in engagement with the piston 31. A force in this direction constantly acts on the piston 31 during the operation of the engine. When the pump 63 starts generating an oil pressure, the hydraulic cutoff poppet valve 64 is initially in the off state and is held in the position in which the oil pressure is applied, so that the retard-side hydraulic chamber 41 is filled with the oil pressure and held in the maximum retarded condition. Because at this time the hydraulic cutoff poppet valve 64 connects the first port 65 to the drain circuit 67, the internal pressure (roughly equal to the atmospheric pressure) of the cylinder head exists inside the advance-side hydraulic chamber 24.

When the retard-side hydraulic chamber 41 is filled with oil pressure, this oil pressure acts on the pressure-receiving surface 33*f* of the second piston 33, bringing the right end face of the outside peripheral edge 33*e* of the second piston 33 into contact with the end 13*a* of the body 13. However, the oil pressure acts on both the left and right end faces of the retainer 34 of the first piston 32, such that the oil pressure inside the retard-side hydraulic chamber 14 does not generate any force that would seek to move the first piston 32 in the horizontal direction. Irrespective of the maximum retarded condition described above and the maximum advance condition described below, the rotational forces (torque) inputted from the crank pulley 51 of the engine 55 to the slit member 15, the gear component 12 of the timing pulley 11, and the timing belt 52 is transmitted to the base components 32*a* and 33*a* of the two pistons 32 and 33 that engage the helical slits 17 of the slit member 15 in a pressed state. Further, that rotational force is transmitted to the camshaft 21 via the helical spline 22 of the passive member 23 that engages the internal peripheral toothed components 32*b* and 33*b* of the two pistons 32 and 33 in the pressed state.

In addition, the camshaft 21 receives fluctuating torque from the cam system and applies surplus rotational motion (rotational motion in the negative direction and the like) to the camshaft 21 in addition to the inherent rotational motion of the camshaft 21. However, as described with reference to FIGS. 6 through 8, the spreading action of the spring 36 securely joins the helical slits 17, the piston 31, and the helical spline 22 without leaving any gaps, thus preventing the generation of knocking such as that resulting from gaps between the joined components.

When the state of the engine 55 is determined based on the various signals inputted to the control device 68 and it is concluded that, for example, the operation is characterized by high speed and a heavy load, the control device 68 actuates the hydraulic cutoff popper valve 64 and sets it in a position in which an oil pressure is applied to the port 65. As a result, the oil pressure is applied to the advance-side hydraulic chamber 42, acting on the pressure-receiving surface 33*g* of the second piston 33. At the same time, the second port 66 is connected to the drain circuit 67 by the hydraulic cutoff poppet valve 64, so the retard-side hydraulic chamber 41 acquires the internal pressure (roughly equal to the atmospherical pressure) of the cylinder head. At this time, there is a gap (see FIG. 8) between the first piston 32 and the second piston 33, and the left slanted end of the base component 32*a* of the first piston 32 comes into contact with the end faces 17*a* of the helical slits 17, moving the second piston 33 in such a way that the gap thereof with the first piston 32 is narrowed. Specifically, the spring 36 is compressed, albeit slightly, weakening the joining of the helical slits 17, the piston 31 and the helical spline 22 by the spreading action thereof. The pressure between base components 32*a* and 33*a* of the piston 31 and the helical slits 17 is therefore reduced, as is the pressure between the helical spline 22 and the internal peripheral toothed helical spline 22 and the internal peripheral toothed components 32*b* and 33*b* of the piston 31, reducing frictional resistance during the movement of the piston 31 and moving the piston in the highly responsive spark advance direction. In other words, while the pressure exerted by the spring 36 in the prescribed direction is reduced (while compressing the spring 36), the piston 31 moves to the left and ultimately reaches the position in the lower portion in FIG. 1. This condition is partially shown in FIG. 3. The action described above continues while a moving force is exerted on the piston 31 (while the oil pressure of the advance-side hydraulic chamber 42 is higher than the oil pressure of the retard-side hydraulic chamber 41).

Thus, the energizing force of the spring 36 is reduced (the spring 36 is compressed) during the movement of the piston 31, such that the force that stretches the base components 32*a* and 33*a* of the two pistons 32 and 33 inside the helical slits 17 is reduced, as is the force with which the helical spline 22 is sandwiched between the internal peripheral toothed components 32*b* and 33*b*; and Thus frictional resistance during the movement of the piston 31 is reduced.

Since the left end face of the outside peripheral edge 33*e* of the second piston 33 comes into contact with the stepped component 14*a* of the cover 14 in the position of the maximum advanced condition shown in the lower part of FIG. 1, the oil pressure inside the advance-side hydraulic chamber 42 for accepting the pressure-receiving surface 33*f* of the second piston 33 is not applied, even indirectly, to the first piston 32. The spreading action of the spring 36 is therefore produced again, and the helical slits 17, the piston 31, and the helical spline 22 are joined securely and without any gaps, as described with reference to FIGS. 6 through 8.

Depending on the manner in which the control of the hydraulic cutoff poppet valve 64 is executed, the piston 31 can be stopped in any position (intermediate advanced position) between the maximum advanced position and the maximum retarded position. This requires that balance be achieved between the oil pressure of the retard-side hydraulic chamber 41 and the oil pressure of the retard-side hydraulic chamber 42 when the piston 31 has achieved an arbitrary position. The amount of the advance can therefore be set to any value between a zero level and a maximum level. Thus, the spreading action of the spring 36 remains effective when the piston 31 has stopped in an arbitrary position, because no movement force is exerted on the piston 31, as described above.

Figure 3:
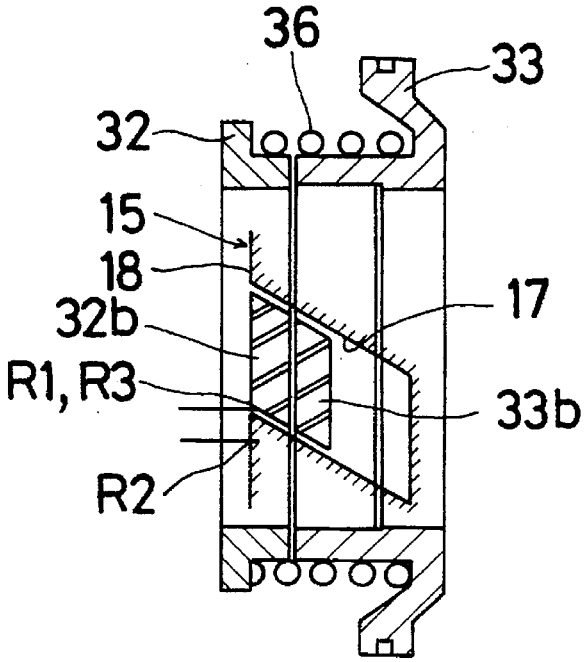
FIG. 3 is a sectional view taken substantially along the line A—A in FIG. 4 (at maximum retarded condition)

The condition of advance will now be described with reference to FIGS. 2 and 3. In FIG. 2, which depicts the condition existing at the time of maximum advance, the standard angular position R1 of the piston 31 coincides with the angular position R2 of the slit member 15. On the other hand, in FIG. 3, which depicts the condition existing at the time of maximum advance, the standard angular position of the slit member 15 coincides with the angular position R3 of the slit member 15. It is understood that the piston 31 advances over the slit member by an angle R4 (=R3–R2) when the piston 31 moves inside the helical slits 17. R4 is again shown in FIG. 13. At the same time, the cam shaft 21 joined to the helical spline 22 advances over the piston 31 by an angle R2 when the piston 31 moves on the helical spline 22. The overall result is that the camshaft 21 advances by an angle R4+R5 in relation to the timing pulley 11.

Figure 11:
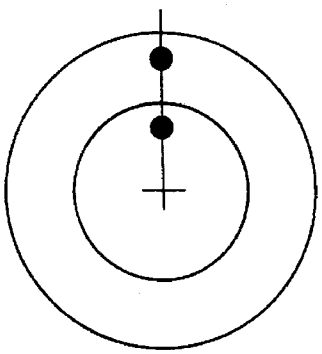
FIG. 11 is an explanatory diagram of the maximum retarded condition.
Figure 12:
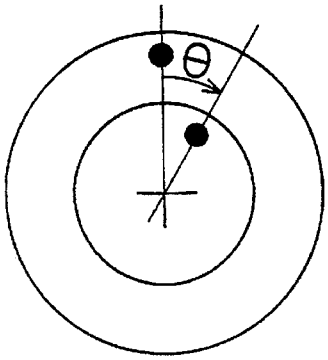
FIG. 12 is an explanatory diagram of the maximum advanced condition.
Figure 13:
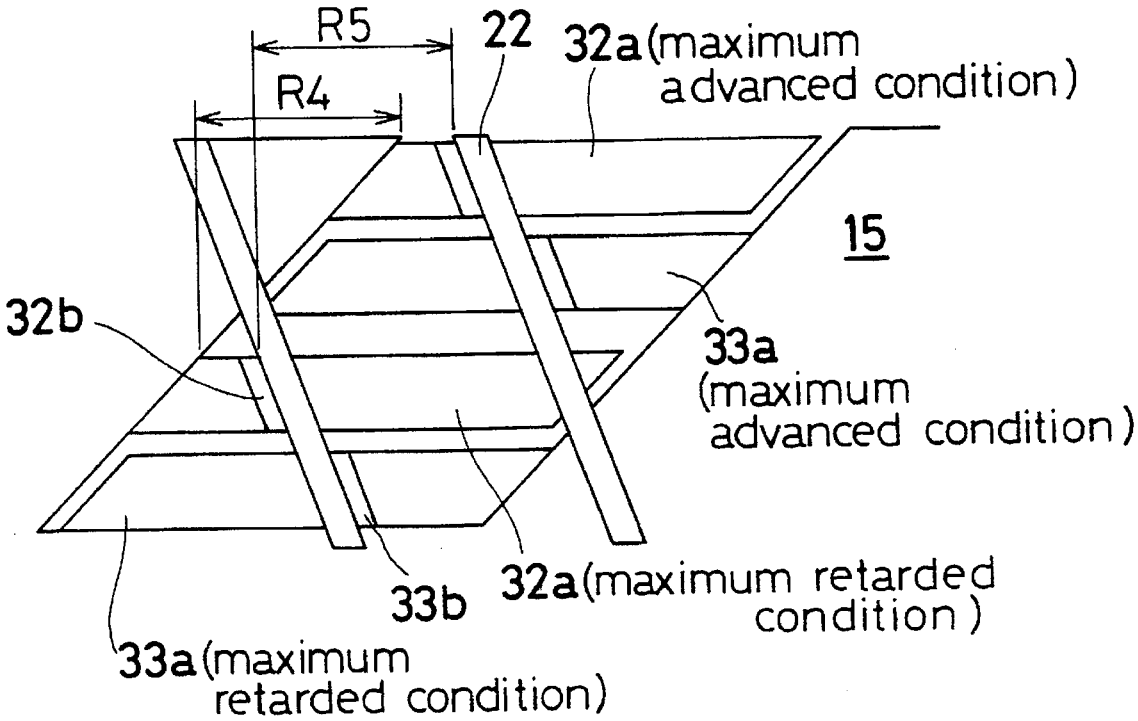
FIG. 13 is an explanatory diagram of the advanced amount.

The state in FIG. 11 exists at the time of maximum retard, and the state in FIG. 12 exists at the time of maximum advance. Here, P1 is the angular position of the timing pulley 11, and P2 the angular position of the camshaft 21. A comparison of the two figures indicates that an advance corresponding to an angle θ exists between P1 and P2 at the time of maximum advance. This angle θ corresponds to the aforementioned value R4+R5.

This first embodiment was described with reference to a case in which a control device 68 actuates a hydraulic cutoff poppet valve 64 and applies oil pressure to a port 65 during a high-speed, heavy(high)-load operation. However, other conditions can also be used for applying the oil pressure to the port 65, and the above components should be properly set on the basis of the particular application. In addition, a belt-driven timing pulley was described as an example of the input member, but any other power input member can be used. Examples include a chain-driven timing gear and one of two mutually engaged gears fitted on a couple of camshafts.

Furthermore, a compression spring, which exerts a spreading action, was described as an example of the elastic member, but an extension spring can also be used as the elastic member, in which case the energizing force in the extension direction must be reduced during spark advance, so the advance-side hydraulic chamber 42 must be placed on the left side of the second piston 33.

Second Embodiment

Figure 14:
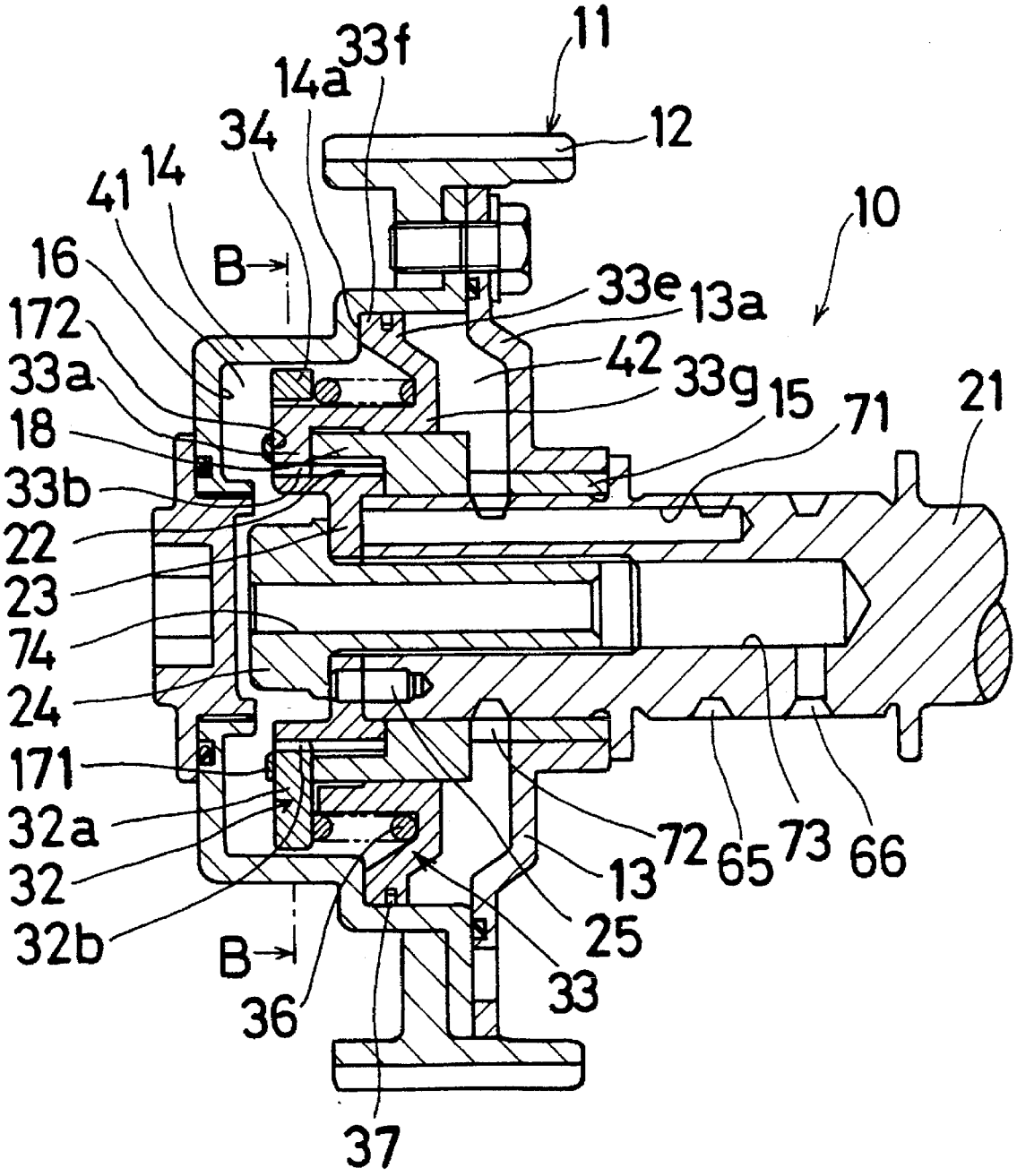
FIG. 14 is a cross-section of a second embodiment of a valve timing control device in accordance with the present invention.
Figure 15:
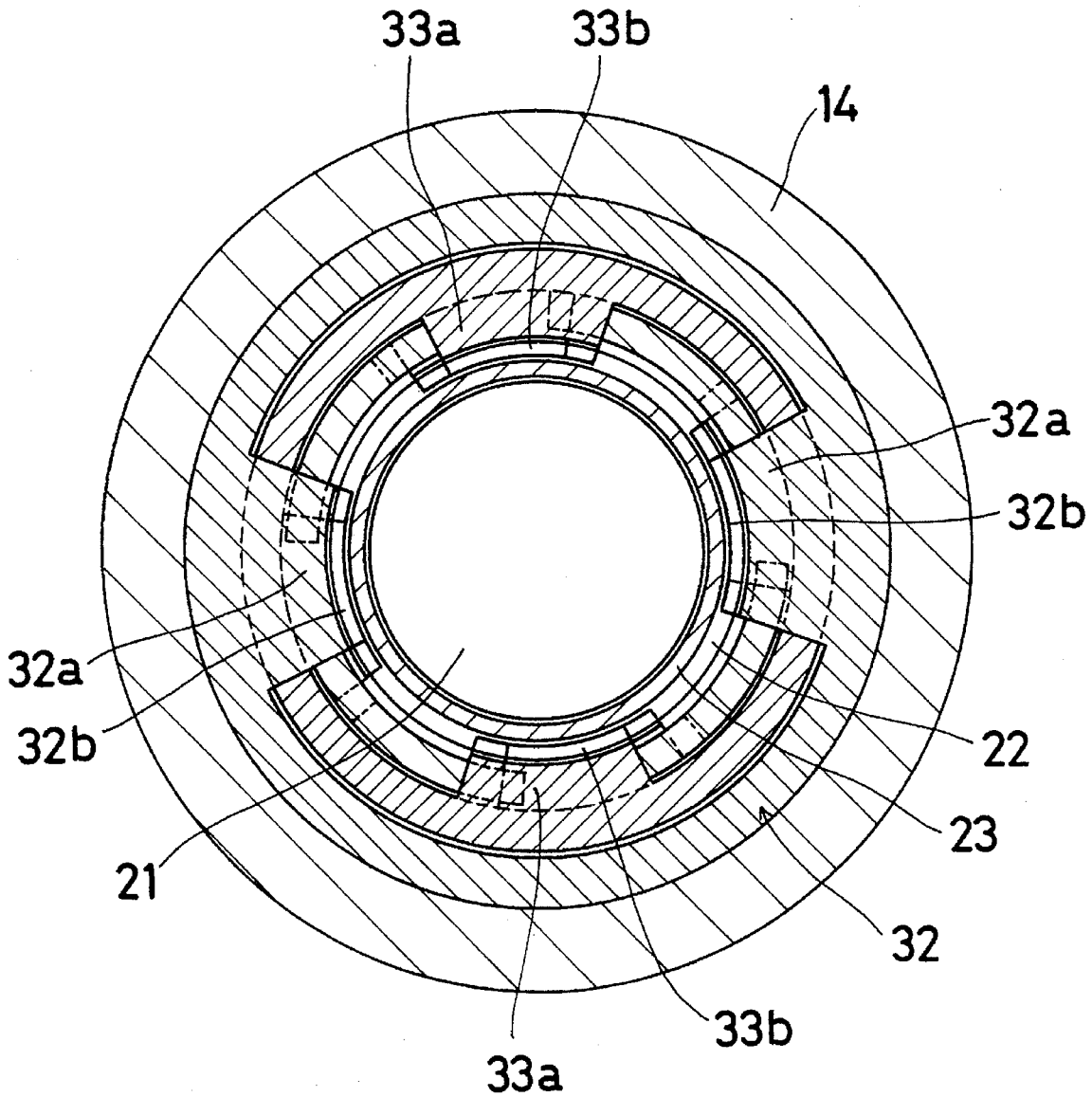
FIG. 15 is a sectional view taken substantially along the line B—B in FIG. 14.
Figure 16:
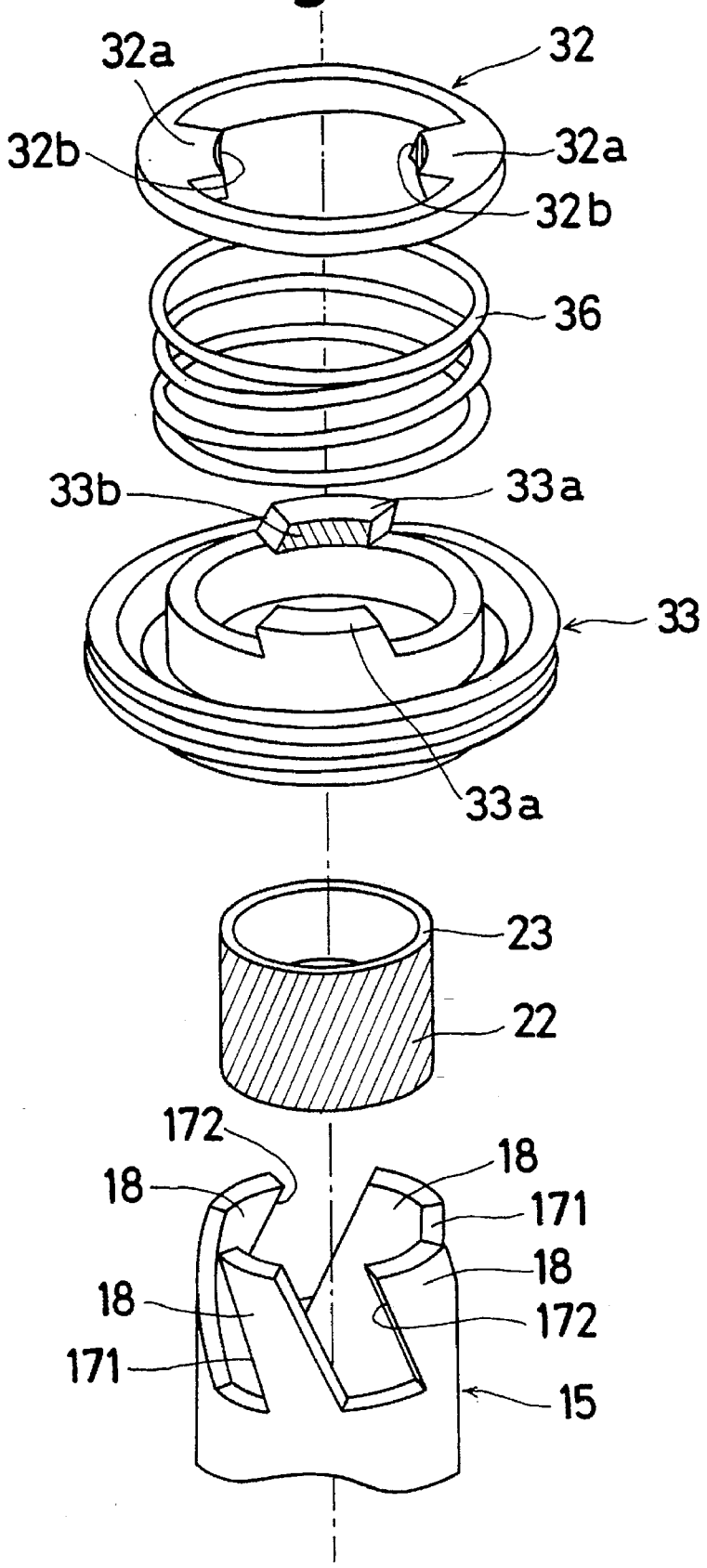
FIG. 16 is a partial exploded perspective view of the assembly illustrated in FIG. 14.

As shown in FIGS. 14 through 16, the valve timing control device of the second embodiment has a structure that is similar to that described with reference to the first embodiment, so the only those parts which are different will be described below.

As shown in FIGS. 15 and 16, a slit member 15 is provided with first and second helical slits 171 and 172, and two first helical slits 171 and two second helical slits 172 are formed along each diagonal. A flange component 18 is provided between a first helical slit 171 and a second helical slit 172, so that the slit member 15 has a total of four flange components 18. The two first helical flanges 171 are inclined in mutually intersecting directions, and the two second helical slits 172 are inclined in mutually intersecting directions. There may be only one first helical slit 171 and one second helical slit 172, or there may be three or more of each of them.

The base component 32*a* of a first piston 32 engages the first helical slit 171, and the base component 33*a* of a second piston 33 engages the second helical slit 172. As in the first embodiment, the base component 32*a* and the base component 33*a* of the second piston 33 are provided, respectively, with internal peripheral toothed components 32*b* and 33*b* that engage the helical spline 22 formed around the outside of a passive member 23. As shown in FIGS. 14 and 15, the base component 33*a* of the second piston 33 is positioned in a prescribed gap inside the first piston 32 along the same circumference (in the same axial position) as the base component 32*a* of the first piston 32 (that is, along the circumference around the axis of the camshaft 21). Specifically, the internal peripheral toothed components 32*b* and 33*b* are positioned along the same circumference (in the same axial position). The base component 32*a* of the first piston 32 may be substituted for the second piston 33.

Figure 17:
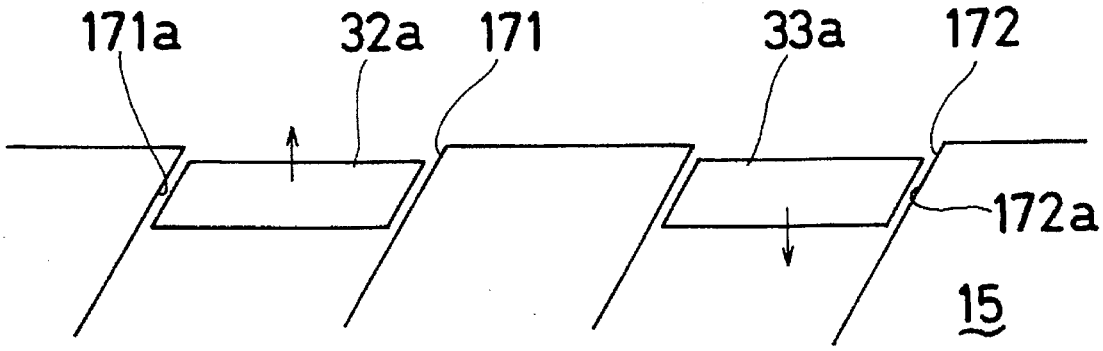
FIG. 17 is an explanatory diagram 1 for illustrating the manner in which spring acts on the piston in the second embodiment.
Figure 18:
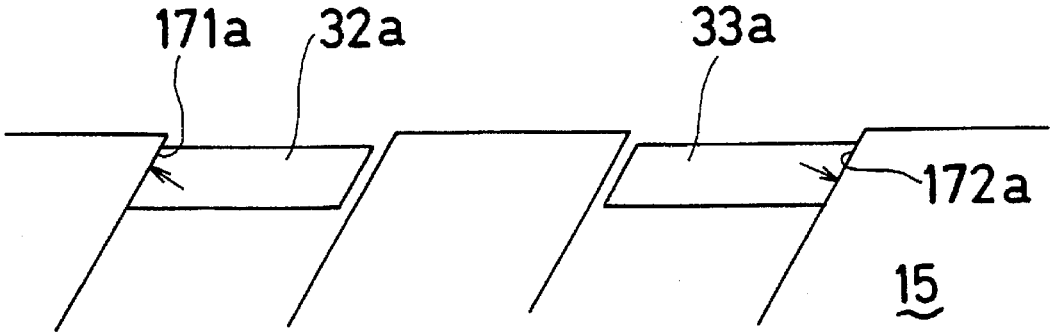
FIG. 18 is an explanatory diagram 2 for illustrating the manner in which spring acts on the piston in the second embodiment.

As in the first embodiment, the first and second pistons 32 and 33 are pushed apart by a spring 36, moving the first piston 32 upward in FIG. 17, and the second piston 33 downward in FIG. 17. Specifically, the spring 36 exerts a spreading action on a piston 31. Therefore, as shown in FIG. 18, the left slanted surface of the base component 32*a* of the first piston 32 is pressed against the end face 171*a* of the first helical slit 171, and the right slanted surface of the base component 33*a* of the second piston 33 is pressed against the end face 172*a* of the second helical slit 172, and, in terms of the entire piston 31, there is no chatter against the helical slits 171 and 172.

Figure 19:
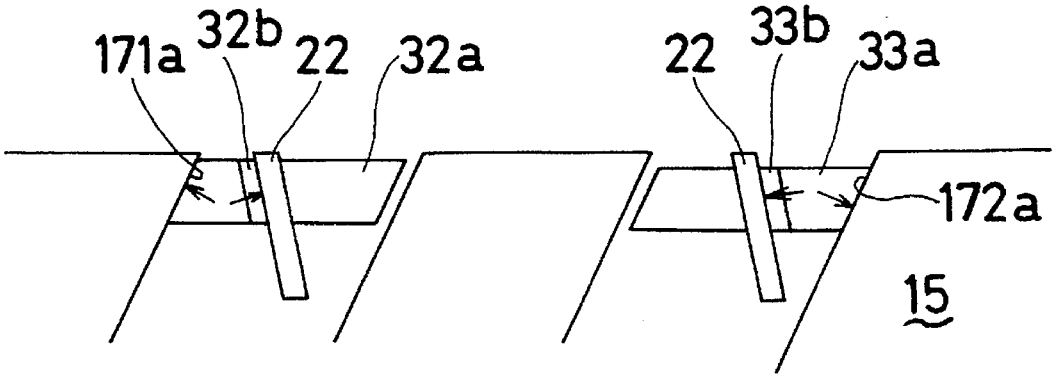
FIG. 19 is an explanatory diagram 3 for illustrating the manner in which spring acts on the piston in the second embodiment.

The base components 32*a* and 33*a* of the two pistons 32 and 33 tend to further move apart the end faces 171*a* and 172*a* of helical slits 171 and 172 as guides, but, as shown in FIG. 19, the internal peripheral toothed component 32*b* is pressed against the helical spline 22, as is the internal peripheral toothed component 33*b*, and, in terms of the entire piston 31, there is no chatter against the helical spline 22. These pressure forces serve as frictional resistance during the movement of the piston 31, and thus act to stop the piston 31 in this position. In FIG. 19, the internal peripheral toothed components 32*b* and 33*b* and the helical spline 22 are shown only for one tooth, with the rest being omitted. The description made with reference to FIGS. 17 through 19 above concerned a case in which the piston 31 was in a state of maximum advance, but the same effect is produced in a state of maximum retard or intermediate advance.

As described with reference to FIGS. 17 through 19, even when the camshaft 21 receives a fluctuating torque from the cam system, the spreading action of the spring 36 securely joins the helical slits 171 and 172, the piston 31, and the helical spline 22 without leaving any gaps, thus preventing the generation of knocking such as that based on gaps between the joined components.

The second embodiment, while yielding the same effect as the first embodiment, further involves providing the slit member 15 with first and second helical slits 171 and 172, and engaging the base component 32*a* of the first piston 32 with the first helical slit 171, and the base component 33*a* of the second piston 33 with the second helical slit 172, respectively, making it possible to place the base components 32*a* and 33*a*, as well as the internal peripheral toothed components 32*b* and 33*b*, in the same axial position. As a result, the axial length of the piston 31 and the axial length of the valve timing control device can be reduced in comparison with those in the first embodiment.

Third Embodiment

Figure 20:
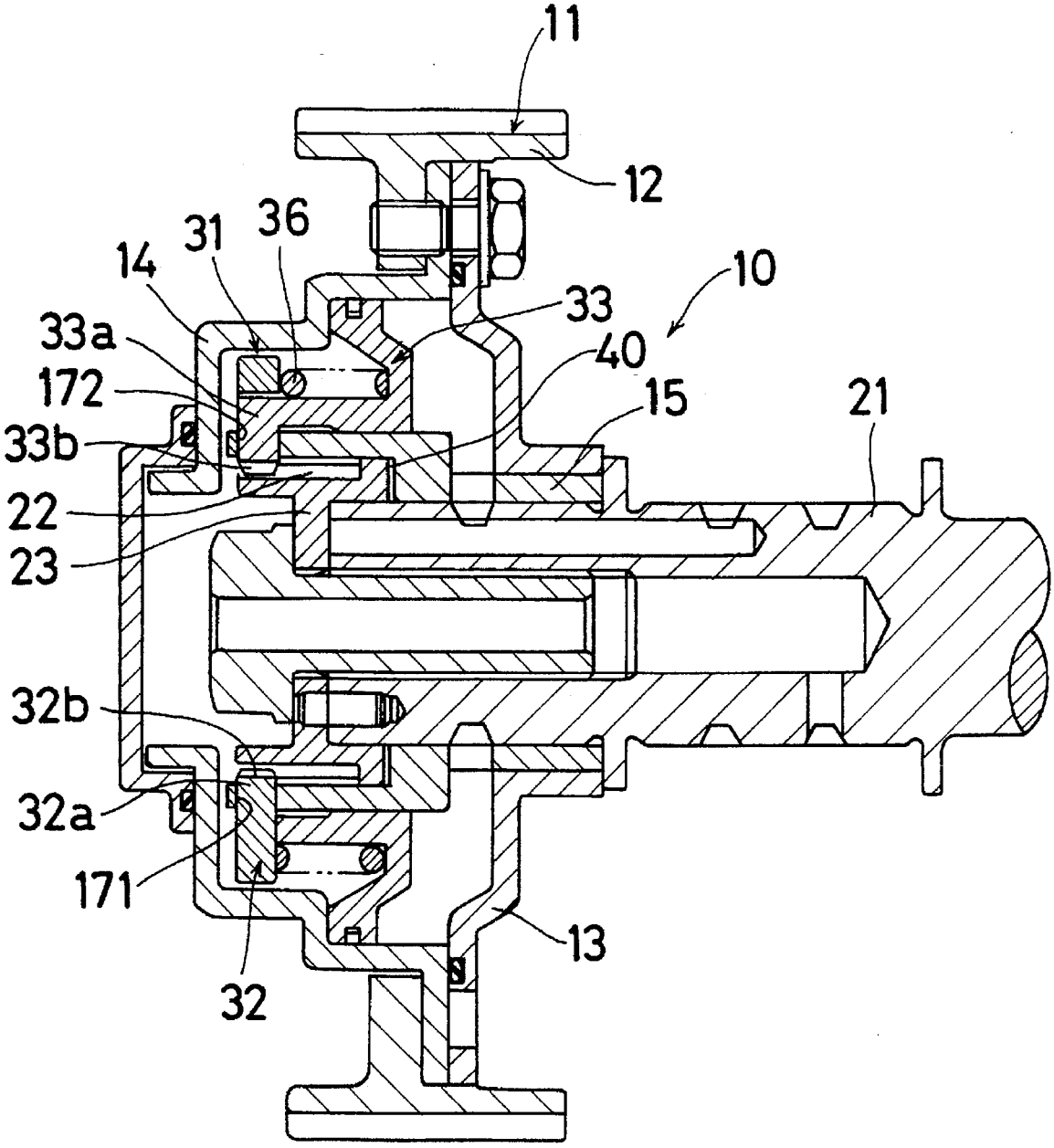
FIG. 20 is a cross-section of a third embodiment of a valve timing control device in accordance with the present invention.

As shown in FIG. 20, the valve timing control device of the third embodiment has the same basic structure as that in the second embodiment, and the only difference with the second embodiment is that a hydraulic chamber 40 is provided between a passive member 23 fitted on a camshaft 21, and a slit member 15 that is a part of a timing pulley 11, and that oil, viscous fluid, or another fluid is sealed inside the chamber. It is also possible to merely form an oil film in the hydraulic chamber 40.

Thus, providing a hydraulic chamber 40 between the passive member 23 and the slit member 15 can prevent as much as possible any axial chatter of the slit member 15 against the passive member 23 or any impact noise (knocking) when fluctuating torque is applied to the camshaft 21 from the cam system.

As mentioned above, according to the present invention, the base component (base portion) of the transmission member engages the helical slit of the slit member, and the toothed component (toothed portion) of the transmission member engages the helical spline of the passive member, thus dispensing with the necessity to form splines between the slit member and the base components of the transmission member and making manufacturing proportionately easier.

Furthermore, according to the present invention, if the transmission member is divided into the first transmission member and the second transmission member and an elastic member having a predetermined urging force in the prescribed direction is disposed between the first and second transmission members, the base components of both transmission members can be pressed to the helical slit and the toothed components of both transmission members can be pressed to the helical spline. As a result, there is neither any chatter between the slit member, the transmission members, and the passive member, nor any chatter-generated knocking between the slit member, the transmission members, and the passive member even when the output member receives a fluctuating torque, making it possible to obtain the noise-free operation of the valve timing control device.

Furthermore, according the present invention, the transmission members may have two pressure-receiving surfaces so that the pressure between the base components of both transmission members and the helical slit and the pressure between the toothed components of both transmission members and the helical spline are reduced when the rotational position of the output member is changed relative to the rotational position of the input member by the movement of the transmission member due to applying pressure to either of the pressure-receiving surfaces. It is therefore capable of reducing the frictional resistance between the transmission members and further capable of improving an advance response.

Furthermore, according to the present invention, the base components or the toothed components can be placed in the same axial position if the slit member includes first and second helical slits, the base component of the first transmission member is allowed to engage the first helical slit, and the base component of the second transmission member is allowed to engage the second helical slit. As a result, the axial length of the transmission members can be reduced, as can the axial length of the valve timing control device.

What is claimed is:

1. A valve timing control device comprising:

an input member to which a drive force is applied thereto;

an output member having on its axis a cam for opening and closing a valve;

a transmission member for transmitting torque between said output member and said input member and for changing the rotational position of said output member in relation to said input member in accordance with the position thereof;

a slit member provided with a helical slit and secured to said input member; and a passive member provided with a helical spline superposed with the helical slit of said slit member and secured to said output member; wherein a base portion which is allowed to engage the helical slit of said slit member and a toothed portion which is allowed to engage with the helical spline of said passive member are formed in said transmission member so that said slit member is connected to said passive member via said transmission member.

2. A valve timing control device as defined in claim 1, wherein said transmission member is divided into a first transmission member and a second transmission member in an axial direction of said transmission member and an elastic member exerting an urging force in a prescribed direction is disposed between said two transmission members so that the base portions of said first and second transmission members are pressed against said helical slits and the toothed portions of said first and second transmission members are pressed against said helical spline.

3. A valve timing control device as defined in claim 2, wherein said transmission members have two pressure-receiving surfaces and the pressure between the base components of both transmission members and the helical slit and the pressure between the toothed components of both transmission members and the helical spline are reduced when the rotational position of the output member is changed relative to the rotational position of the input member by the movement of the transmission member due to the applying pressure to either of the pressure-receiving surfaces.

4. A valve timing control device as defined in claim 2, wherein said slit member has a cylindrical shape;

a pair of said helical slits extended in the axial direction are formed in said slit member at regular intervals in the circumferential direction;

said first and second transmission members are fitted around the outside of said slit member while allowed to move in the axial direction;

said first and second transmission members are each provided with a pair of base portions capable of engaging said pair of helical slits;

one of the helical slits is engaged by one of the base portions of each transmission member; and the other helical slit is engaged by the other base portions of each transmission member.

5. A valve timing control device as defined in claim 4, wherein said passive member is positioned inside of a radial direction of said slit member and toothed portions in engagement with the helical spline of said passive member are formed on the internal peripheral surfaces of the base portions of said first and second transmission members.

6. A valve timing control device as defined in claim 2, wherein said slit member has a cylindrical shape;

a pair of said helical slits extending in the axial direction are formed in said slit member at regular intervals in the circumferential direction;

said first and second transmission members are fitted around the outside of said slit member while allowed to move in the axial direction;

said first transmission member is provided with a pair of base portions, each of which is capable of engaging one pair of helical slits of said slit member; and said second transmission member is provided with a pair of base portions, each of which is capable of engaging the other pair of helical slits of said slit member.

7. A valve timing control device as defined in claim 6, wherein said passive member is positioned inside of a radial direction of said slit member and toothed portions in engagement with the helical spline of said passive member are formed on the internal peripheral surfaces of the base portions of said first and second transmission members.

8. A valve timing control device as defined in claim 7, wherein the base portions and toothed portions of said first transmission member, and the base portions and toothed portions of said second transmission member, are in the same axial position.

9. A valve timing control device as defined in claim 1, wherein a fluid chamber containing a fluid is formed between said slit member and said passive member.

* * * * *